United States Patent [19]

Erickson

[11] 4,076,368

[45] Feb. 28, 1978

[54] TERMINAL FASTENER AND INSTRUMENT TAP

[75] Inventor: John W. Erickson, Crystal Lake, Ill.

[73] Assignee: Boltswitch Inc.

[21] Appl. No.: 554,768

[22] Filed: Mar. 3, 1975

Related U.S. Application Data

[63] Continuation of Ser. No. 396,384, Sep. 12, 1973, abandoned.

[51] Int. Cl.[2] ..... H01R 13/50

[52] U.S. Cl. ..... 339/214 R; 339/221 R

[58] Field of Search ..... 339/214, 221, 269, 263; 151/41.73

[56] References Cited

U.S. PATENT DOCUMENTS

| | | | |
|---|---|---|---|
| 2,307,080 | 7/1943 | Schaefer | 151/41.73 |
| 2,465,654 | 3/1949 | Millard | 339/214 R |
| 2,688,497 | 9/1954 | Brisack | 151/41.73 |
| 3,766,442 | 10/1973 | Pearce et al. | 339/220 R |

FOREIGN PATENT DOCUMENTS

| | | | |
|---|---|---|---|
| 1,028,657 | 2/1953 | France | 339/214 R |
| 739,371 | 10/1932 | France | 339/214 R |

*Primary Examiner*—Joseph H. McGlynn
*Assistant Examiner*—Howard N. Goldberg

[57] ABSTRACT

A combination mounting device and instrument tap for a terminal of a high amperage switch, comprising a knurled cylindrical steel insert press-fit into a punched hole in a switch terminal flange. The insert has a head overlapping the punched hole and fixedly mounting an instrument connection terminal in firm electrical contact with the switch terminal flange. A fastener bolt is threaded through a tapped opening in the insert to mount the switch terminal on an insulator base.

2 Claims, 6 Drawing Figures

TERMINAL FASTENER AND INSTRUMENT TAP

Cross-Reference to Related Application

This application is a continuation of application Ser. No. 396,384, filed Sept. 12, 1973, now abandoned.

BACKGROUND OF THE INVENTION

This invention is directed to high amperage bolted pressure contact switches and more particularly to a combination switch terminal fastener means and instrument tap for such a switch.

In many installations of high amperage bolted pressure contact switches it is necessary or desirable to provide some means for measuring the voltage drop across the switch contacts or across the cartridge fuses that are incorporated in the switch or both. To make these measurements, electrical instrument connections are usually necessary at three locations on the switch structure. Because space is usually limited around these switches, and because foreign objects must be maintained beyond arcing distance and away from the moving parts of the switch, the connections for the instruments are generally made to the switch terminal flanges.

The hard copper which forms the switch terminal flanges is difficult to work; attempts to drill and tap separate holes for each instrument connection generally lead to a high breakage rate for the drills and taps used. Also, since the available space on the switch terminal flanges is often limited, the combination of an instrument terminal and the fastening means for mounting the switch to the insulator board is advantageous. Thus, the instrument terminal of the invention may be associated with the fastening means which are normally provided to hold the switch components to the insulator board.

Other objects and purposes of this invention may be found in the following specification, claims and drawings.

SUMMARY OF THE INVENTION

It is a principal object of the invention, therefore, to provide a new and improved fastener means for mounting a high amperage hard copper switch terminal on an insulator base, which fastener means also serves as a convenient and effective instrument tap for the switch.

A further object of the invention is to provide a new and improved combination mounting device and instrument tap for a high amperage switch terminal that is simple and economical to manufacture, convenient to install, and requires only an ordinary punched hole in the terminal.

A specific object of the invention is to provide a fastener assembly that fixedly mounts an instrument terminal on a high current switch terminal prior to use of components of the same assembly in mounting the switch terminal on an insulator base.

Accordingly, the invention relates to a combination switch terminal fastener means and instrument tap for a high amperage bolted pressure contact switch. The switch is mounted on an insulator base and has switch terminals of hard copper with flanges which abut the insulator base. A number of smooth-walled mounting apertures extend through each flange and fastening means fit through these holes to mount the switch components on the insulator base. The combination fastening means includes a cylindrical steel insert having a knurled portion which is press-fit into one of the mounting apertures in a switch terminal flange and an enlarged head portion which is incapable of being inserted in the mounting aperture. A threaded opening extends axially of the insert; a bolt extends through the insulator base and is threaded into this opening to fasten the switch terminal to the insulator base. An instrument connection terminal is helf between the head portion of the insert and the switch terminal flange, independently of the bolt. The instrument terminal has an offset portion containing means for attachment to an electrical measuring instrument.

DESCRIPTION OF THE PREFERRED EMBODIMENT

Figure 1:
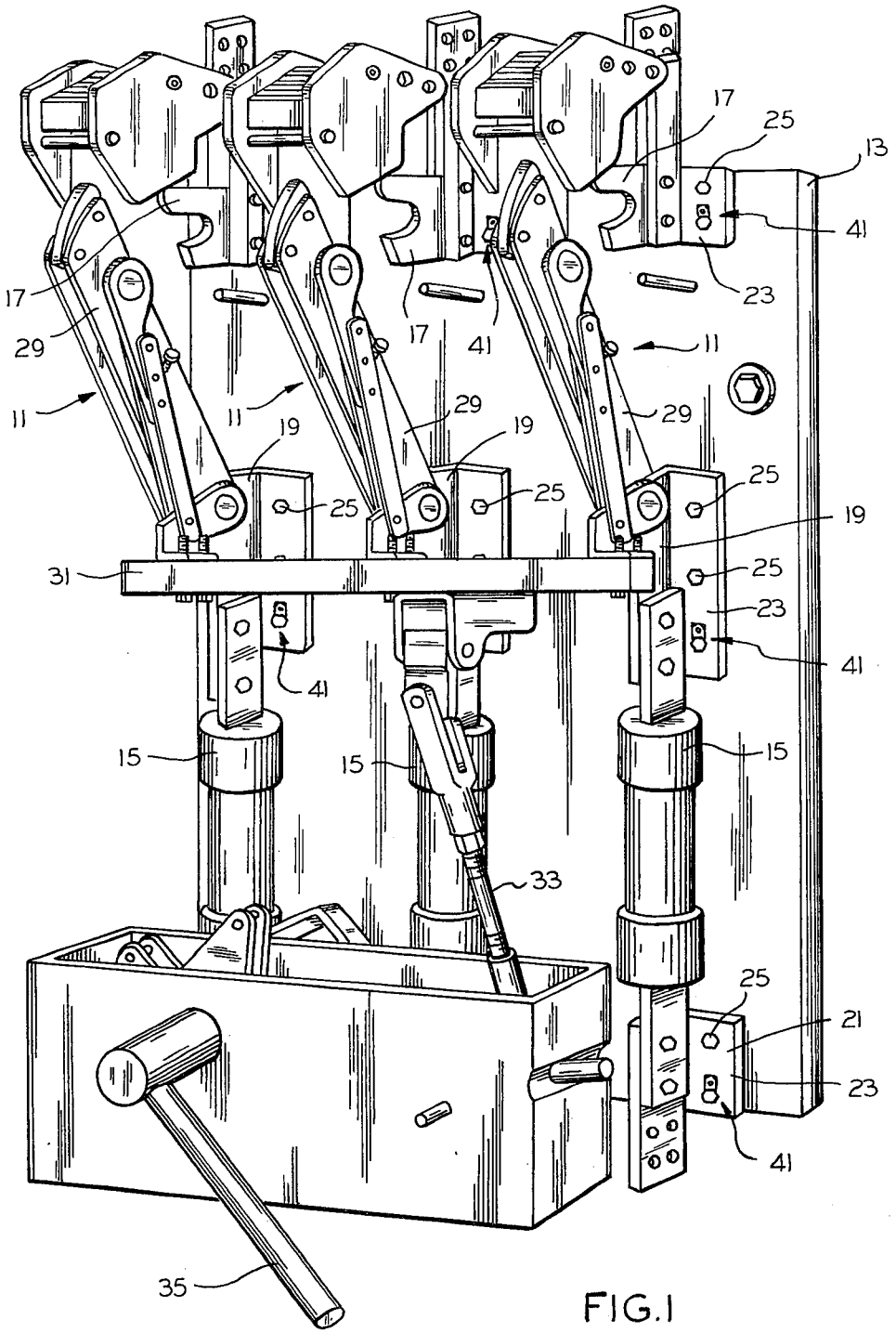
FIG. 1 is a perspective view of a three pole high amperage bolted pressure contact switch embodying the novel features of this invention.
Figure 3:
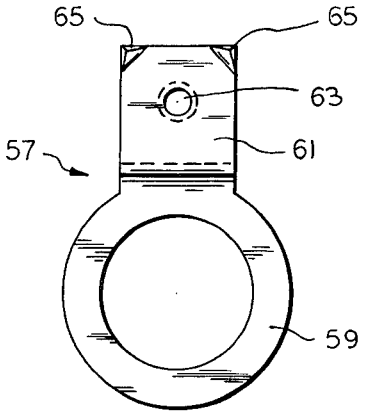
FIG. 3 is a front elevational view of the instrument connection terminal of this invention.
Figure 2:
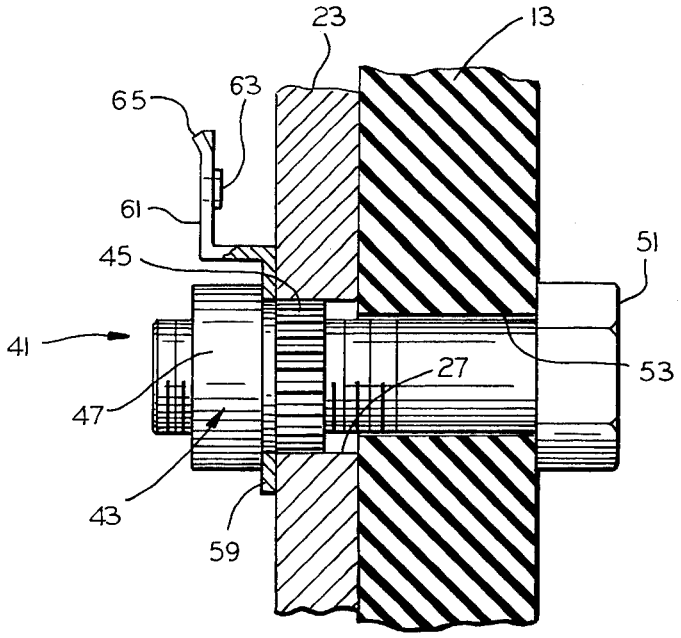
FIG. 2 is an enlarged cross-sectional view of a switch terminal fastening means and instrument tap of this invention.
Figure 4:
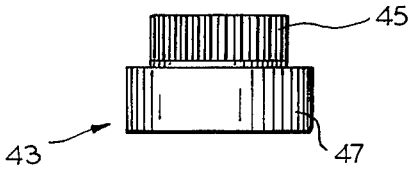
FIG. 4 is a side elevational view of the fastener insert.
Figure 5:
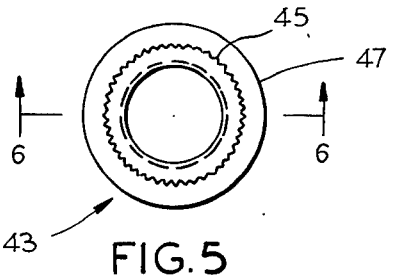
FIG. 5 is a top plan view of the insert of FIG. 4.
Figure 6:
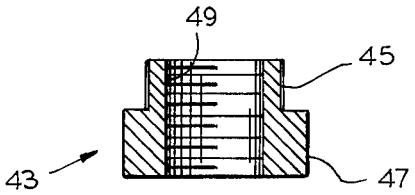
FIG. 6 is a cross-sectinal view taken along lines 6—6 in FIG. 5.

FIG. 1 of the drawings shows a three pole high amperage bolted pressure contact switch, the three poles 11 being mounted on an insulator base 13. Also mounted on the insulator base and individually connected to each switch pole are three cartridge fuses 15. Each pole of the switch includes terminals such as a main terminal 17, a blade terminal 19 and a fuse terminal 21. Each terminal is generally L-shaped in cross-section having a flange 23 which abuts the insulator base 13. The terminals are of hard copper which is formed and coined to the proper shape. The terminals are supported on and held to the insulator base by means of bolts 25 which pass through mounting apertures 27 extending through the flanges. The mounting apertures 27 are preferably formed as punched holes. The blades 29 of the switch are ganged by a crossbar 31. A rod 33 connects the crossbar to an operating lever 35.

One novel aspect of this invention resides in the replacement of some of the bolts 25 with a switch terminal fastening means which also functions as an instrument tap. The combined switch terminal fastening means and instrument tap 41 of this invention, which replaces one bolt 25 in each switch terminal flange 23 is shown in detail in FIGS. 2 through 6 of the drawings. The fastening means and tap 41 includes a cylindrical steel insert 43 having a knurled portion 45, which is press-fit into one of the puched holes 27 in a switch terminal flange, and an enlarged head portion 47 which will not fit into the punched hole 27. A threaded opening 49 extends longitudinally axially through both the knurkled and headed portions of the cylindrical insert 43. A bolt 51 positioned with its head against the back of the insulator base 13 extends through an opening 53 in the insulator base and threads into the threaded opening 49 in the cylindrical steel insert to hold the terminal flange 23 in engagement with the insulator base 13.

An instrument tap or terminal 57 is forced into firm electrical contact with the terminal flange 23 by the head portion 47 of the steel insert 43. This instrument terminal 57 includes a ring-shaped base 59 which fits over the knurled portion 45 of the insert and an offset portion 61, which is spaced from the flange 23. A threaded opening 63 or other attachment means is formed in the offset portion 61 for receiving a fastener to hold an instrument connector. The upper corners of the offset portion 61 are bent in at 65 to align the instrument connector.

As shown in the drawings, the switch terminal fastening means and instrument taps 41 are used to replace some of the mounting bolts 25 normally holding the terminals to the insulator base. This improved fastening means may be used on the main terminal, the blade terminal and the fused terminal of each switch so that readings of the voltage drops across the switch contacts and the fuses may be easily made.

The combination switch terminal fastener means and instrument tap of the invention affords a direct, essentially zero impedance instrument tap connection to the switch terminal flange. No threading or other expensive machining of the switch terminal is required; simple punched holes in the switch terminal flange can be used. Assembly of the switch requires minimum labor, corresponding to that required for ordinary bolt fasteners. The insert 43 mounts the instrument connection terminal 57 on the switch terminal flange 23 independently of the presence of the bolt 51 so that the major switch components can be handled and even slipped separately from the insulator base without adding to the complications or expense of subsequent assembly.

I claim:

1. A combination switch terminal fastener means and instrument tap for a high amperage bolted pressure contact switch of the type comprising an insulator base and having switch terminals of hard copper with each switch terminal having a flange abutting said insulator base, and a smooth-walled mounting aperture extending through said flange, said fastener means and instrument tap including:

a cylindrical steel insert, having a knurled portion press-fit into said mounting aperture of said switch terminal flange, and an enlarged head portion incapable of being inserted into said mounting aperture, said enlarged head portion having a radially extending end surface facing the terminal flange, and a threaded hole extending axially of said cylindrical insert;

an instrument connection terminal having a flat base portion engaged and held in firm electrical contact with said switch terminal flange by said radially extending end surface of said insert head portion and an offset portion including means for attachment to an electrical instrument; and a bolt extending through said insulator base and engaging said threaded hole of said cylindrical insert to mount said switch terminal flange on said insulator base and to afford increased contact pressure between said instrument connection terminal and said switch terminal flange.

2. A combination switch terminal fastener means and instrument tap according to claim 1, in which said knurled portion of sad insert is of circular external configuration and said switch terminal aperture is a punched hole.

* * * * *